US009406208B2

(12) United States Patent
Dobbins et al.

(10) Patent No.: US 9,406,208 B2
(45) Date of Patent: Aug. 2, 2016

(54) MOBILE CASH TRANSPORT SYSTEM WITH TAMPERING TRIGGERED INK DEPLOYMENT

(71) Applicants: Aaron H. Dobbins, Cherry Hill, NJ (US); Bob M. Dobbins, Villanova, PA (US); Thomas Carullo, Marlton, NJ (US); Robert D. Ross, Gibbsboro, NJ (US)

(72) Inventors: Aaron H. Dobbins, Cherry Hill, NJ (US); Bob M. Dobbins, Villanova, PA (US); Thomas Carullo, Marlton, NJ (US); Robert D. Ross, Gibbsboro, NJ (US)

(73) Assignee: Ellenby Technologies, Inc., Woodbury Heights, NJ (US)

( * ) Notice: Subject to any disclaimer, the term of this patent is extended or adjusted under 35 U.S.C. 154(b) by 84 days.

(21) Appl. No.: 14/302,598

(22) Filed: Jun. 12, 2014

(65) Prior Publication Data

US 2014/0368343 A1 Dec. 18, 2014

Related U.S. Application Data

(60) Provisional application No. 61/834,148, filed on Jun. 12, 2013.

(51) Int. Cl.

| | |
|---|---|
| ***G08B 13/06*** | (2006.01) |
| ***G08B 13/12*** | (2006.01) |
| ***E05G 1/00*** | (2006.01) |
| ***E05G 1/10*** | (2006.01) |
| ***E05G 1/14*** | (2006.01) |
| *G08B 13/14* | (2006.01) |

(52) U.S. Cl.

CPC ..... *G08B 13/126* (2013.01); *E05G 1/005* (2013.01); *E05G 1/10* (2013.01); *E05G 1/14* (2013.01); *G08B 13/1436* (2013.01)

(58) Field of Classification Search

CPC ..... E05G 1/005; E05G 1/10; E05G 1/14; G08B 13/126; G08B 13/1436

USPC ..... 340/541

See application file for complete search history.

(56) References Cited

U.S. PATENT DOCUMENTS

| | | | |
|---|---|---|---|
| 4,805,222 | A | 2/1989 | Young |
| 5,598,793 | A | 2/1997 | Lopez |
| 5,952,920 | A | 9/1999 | Braddick |
| 6,564,726 | B1 | 5/2003 | Lindskog |
| 7,100,520 | B2 | 9/2006 | Abe et al. |
| 7,281,477 | B2 | 10/2007 | Dyson et al. |
| 7,516,832 | B2 | 4/2009 | Dobbins |
| 7,707,950 | B2 | 5/2010 | Villiger |

(Continued)

FOREIGN PATENT DOCUMENTS

JP 04098387 A 3/1992

OTHER PUBLICATIONS

Dobbins, Aaron and Ianacci, Fran, "Eye in the Sky Security System Project", (May 2004), http://people.ece.cornell.edu/land/courses/ece4760/FinalProjects/s2004/fci2/highleveldesign.html.

*Primary Examiner* — Omer S Khan

(74) *Attorney, Agent, or Firm* — Hultquist, PLLC; Peter H. Priest

(57) ABSTRACT

A device designed to transport paper currency in a protected fashion. While being transported, the device monitors for tampering or break-in attempts and subsequently generates warning notifications, devalues currency with indelible ink, or sounds an alarm depending on configuration and the type of tampering detected. Further, techniques are described for transferring indelible ink efficiently and reliably to a cash compartment area of the transport case.

14 Claims, 10 Drawing Sheets

(56) References Cited

U.S. PATENT DOCUMENTS

| | | | | |
|---|---|---|---|---|
| 8,054,183 | B2 | 11/2011 | Villiger | |
| 8,134,464 | B2 | 3/2012 | Lynch et al. | |
| 8,332,932 | B2 | 12/2012 | Kellas-Dicks et al. | |
| 2003/0005882 | A1* | 1/2003 | Fumanelli | G08B 15/02 118/300 |
| 2005/0000396 | A1* | 1/2005 | Dyson | G07D 11/0093 109/25 |
| 2006/0028341 | A1* | 2/2006 | Bartholf | G07F 19/20 340/570 |
| 2008/0252084 | A1* | 10/2008 | Francis | G09F 3/0335 292/317 |
| 2008/0278322 | A1* | 11/2008 | Villiger | E05G 1/005 340/568.1 |
| 2009/0235847 | A1 | 9/2009 | Villiger | |
| 2011/0155026 | A1 | 6/2011 | Villiger | |
| 2014/0239007 | A1* | 8/2014 | McBride | G07F 19/203 221/1 |

* cited by examiner

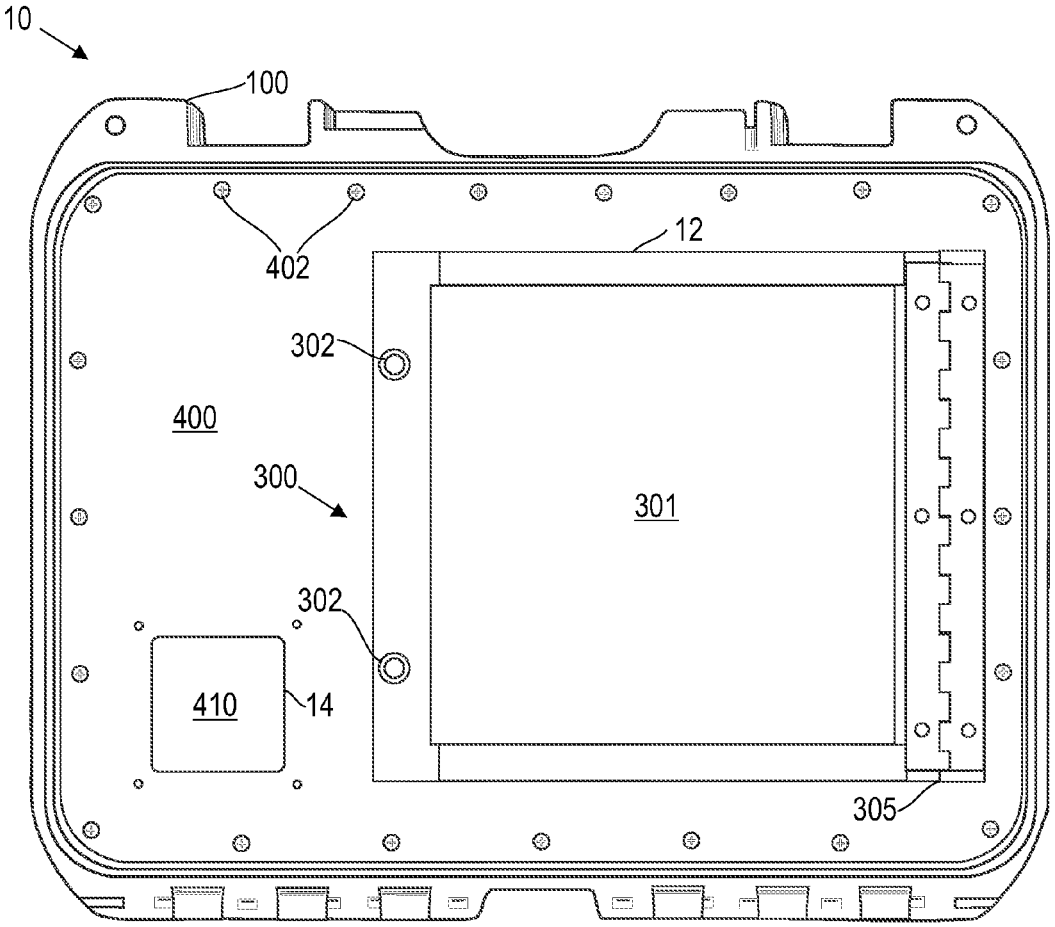
FIG. 1
FIG. 2
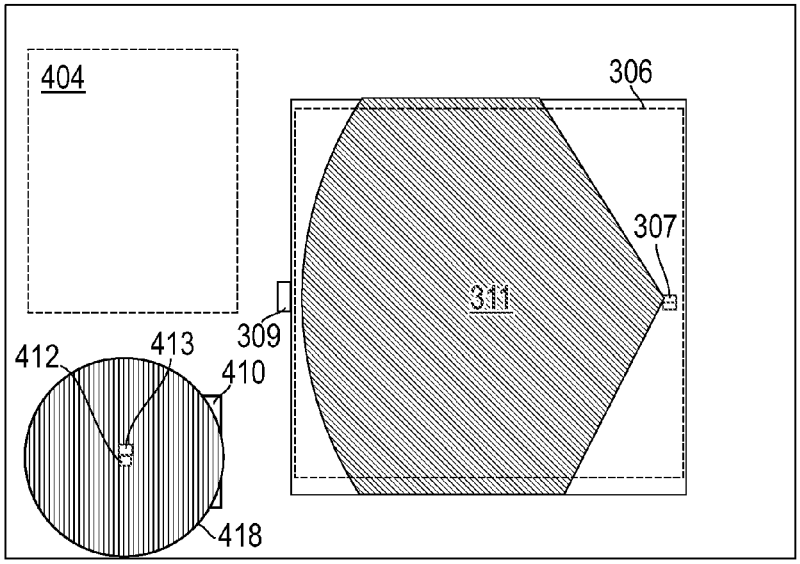

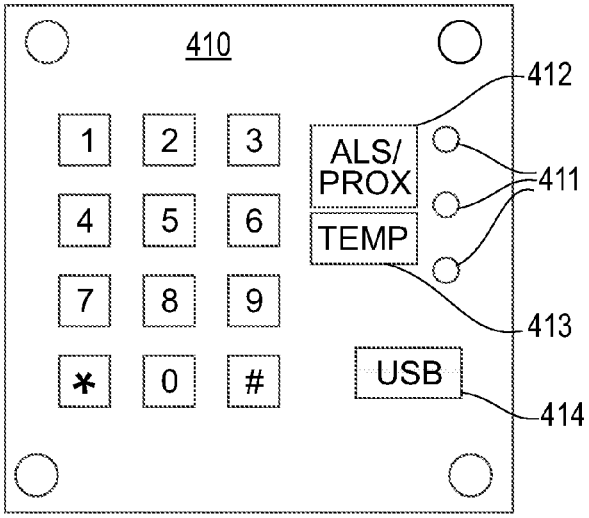
FIG. 3
FIG. 4
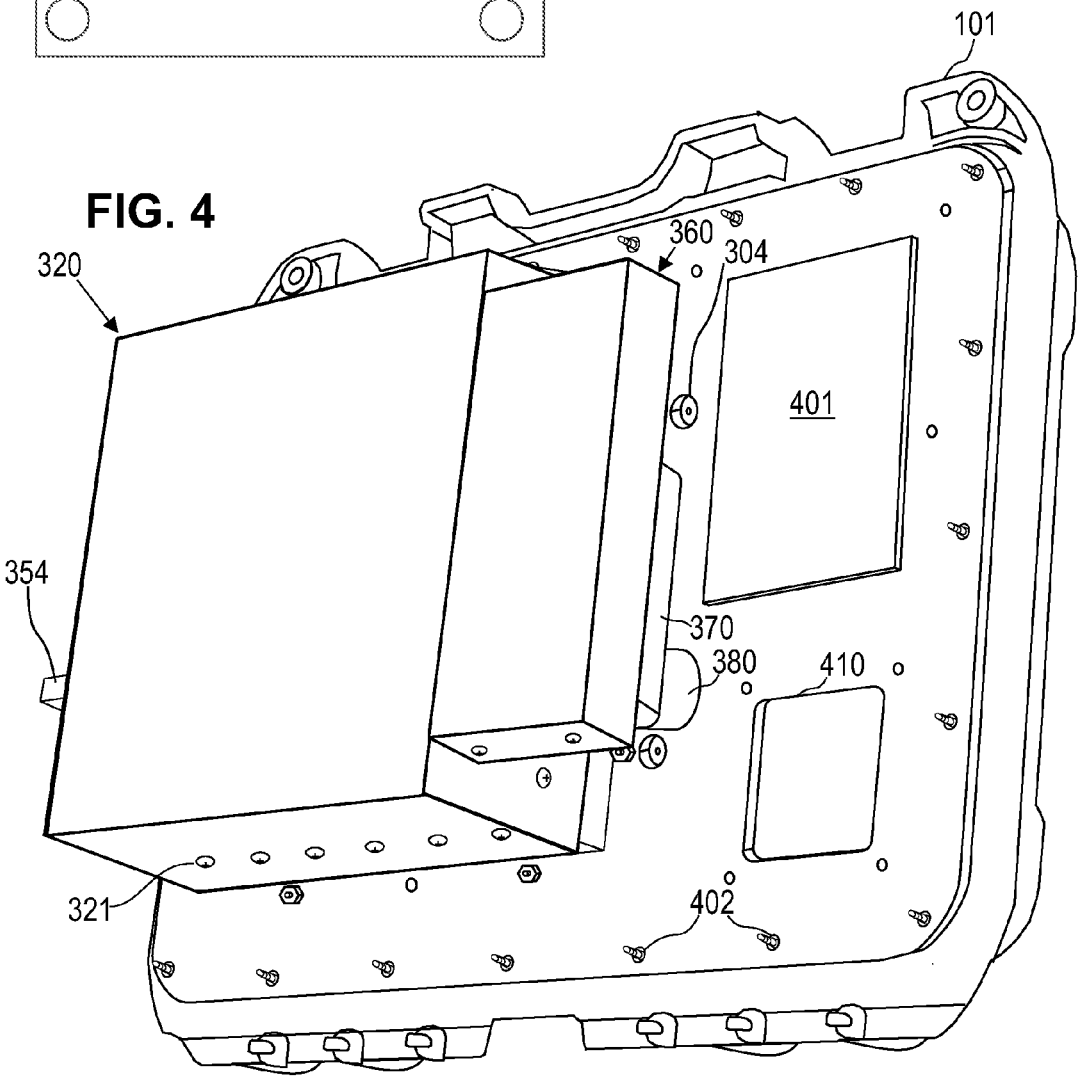

CROSS-SECTION X-Y PLANE

MOBILE CASH TRANSPORT SYSTEM WITH TAMPERING TRIGGERED INK DEPLOYMENT

The present application claims the benefit of U.S. Provisional Application Ser. No. 63/834,148 entitled "Mobile Cash Transport System with Tampering Triggered Ink Deployment", filed Jun. 12, 2013 which is incorporated by reference in its entirety.

The present application is related to U.S. patent application Ser. No. 14/302,555 entitled "Method and Apparatus for Mobile Cash Transportation" filed on Jun. 12, 2014 which claims the benefit of U.S. Provisional Patent Application Ser. No. 61/834,120 entitled "Method and Apparatus for Mobile Cash Transportation" and filed on Jun. 12, 2013 both of which are incorporated by reference herein in their entirety.

FIELD OF THE INVENTION

The present invention relates generally to improved methods and apparatus for mobile cash storage and transportation. More particularly, the present invention relates to advantageous aspects of an improved transport case with tampering triggered ink deployment.

BACKGROUND OF THE INVENTION

Devices used to securely transport paper currency are offered in many forms and styles from sturdy metal cases to locked nylon zipper bags. In recent years, a number of more sophisticated cash carrying devices have been introduced that add indelible ink deployment mechanisms to devalue currency in the event of theft. Additionally, electronic controls with tamper detection sensors have been employed to detect theft. These solutions involve elaborate ink delivery systems and limited electronic monitoring capabilities resulting in heavy and expensive cash carrying devices.

In a series of patents and patent applications, Villiger discloses cash carrying devices that have a mechanism for devaluing the currency based on signals from protection circuitry whose parameters are configured over a communication link to an interfacing piece of equipment. in U.S. Pat. No. 8,054,183, Villiger teaches a cash carrier system in which a portable computer travels alongside the cash carrier to authenticate the credentials of the cash handlers and to determine when the cash carrier should be armed and disarmed. A similar system is described in Villiger's U.S. Patent Application Publication No. 2011/0155026, in which a security cassette comprising a cash devaluing agent and tamper detecting sensors, is interfaced via an optical link with an optical transmitter for the purpose of setting security parameters which may include arm/disarm information or location information. Additionally, in Villiger's U.S. Pat. No. 7,707,950, a system is disclosed in which a cash strongbox area is interfaced to a removable handle portion that contains a security circuit that communicates to an electronic protection module inside the strongbox through a communication link within the interface.

In the above disclosed systems, a separate interface forms a critical portion of the security system. Those interfaces require the use of external hardware or specialized mechanical interlocks that call attention to the carrier personnel. Without the use of the interfacing hardware, the cash transport system's capabilities are significantly limited.

Another series of products relates to equipping standard transport cases, such as briefcases, with cash security systems. Villiger U.S. Patent Application Publication No. 2009/0235847 discusses a kit that can be installed in a case that consists of a pressurized ink deployment mechanism and associated security circuitry to arm, disarm, and detect tampering attempts.

These types of retrofit kits attempt to protect a large volume of interior case space through the use of large amounts of ink, pressurized air, and distributor plates to direct the pressurized ink to the interior space. Pressurized air deployment systems like those described by Villiger as well as by Lopez in U.S. Pat. No. 5,598,793, require the use of specially designed air tight valves and igniters or solenoids which result in a mechanically complicated and heavy solution. The air canisters are also vulnerable to leakage over time which would render the product ineffective upon loss of adequate air pressure to suitably deploy the ink.

Besides the use of pressurized air canisters, another approach to ink deployment involves the use of blade assemblies to open ink pouches. Lindskog describes a system in U.S. Pat. No. 6,564,726 in which an ink pouch is slit open in a guillotine fashion. Dyson follows a similar guillotine approach in U.S. Pat. No. 7,281,477, but adds the element of pressurizing the ink with spring plates before slitting them open to better distribute the ink contents on the cash. Masamichi describes a spring-loaded arm with spikes that drives into an ink pouch in Japanese Patent Application Publication No. 04098387. Abe purports to improve on this concept by pressurizing the ink pouch with a spring plate before releasing bracket that separates the ink pouch from a spike plate in U.S. Pat. No. 7,100,520.

The use of blades to puncture ink pouches can result in a simpler mechanical assembly than the use of pressured air canisters, and the above disclosures point out an advantage to pressurizing the ink pouch before puncturing to ensure thorough ink coverage within the cash compartment which the non-pressurized, gravity-fed ink deployment systems lack. The continuous pressurization of the ink pouch results, however, in the need for a strong pouch wall that will not breach prematurely under the applied pressure.

Other ink deployment schemes involve the use of fragile glass vials located near the items they are configured to devalue that are shattered by tamper attempts as taught by Lynch in U.S. Pat. No. 8,134,464. Braddick teaches a pyrotechnic chemically activated ink pouch with a coupled transceiver to initiate a reaction to release ink and smoke in U.S. Pat. No. 5,952,920. These approaches can result in dangerous glass or plastic shards mixed in with the cash, or significant destruction of the cash from fire or chemical burn.

SUMMARY OF THE INVENTION

One object of this invention is to present a highly reliable, readily portable, and cost effective alternative solution.

According to another aspect, the present invention discloses a mechanical design which provides all the benefits of pressurized ink deployment, but none of the additional expense of reinforced pouch walls to prevent premature breaching.

Another aspect is that the present invention seeks to deploy ink in a safe and highly reliable manner which reduces the risk of permanent destruction of the transport case and leaves the cash structurally intact for later identification.

Further, it is one objective of the current invention to provide a cash stronghold module configured to hold an indelible ink pouch in an unpressurized state adjacent to a cash compartment area. Upon activation, the ink pouch is pressed into a spike plate assembly that pressurizes the ink at the moment of deployment. The spike plate assembly tears the bag open and forces the ink contents outward in the direction of the cash compartment. The stresses on the ink pouch are minimal prior to deployment which results in a reduced chance of an unintentional pouch breach or a pouch failure. In the pre-deployed state, the ink pouch is held away from the spike plate by a perforated stiffener plate that is held a distance away from the spike plate tips. One presently preferred mechanism to achieve this separation is one or more conical compression springs that are designed to compress nearly flat. In the deployed state, the ink is confined so that it flows only to the cash compartment area thereby reducing the amount of ink necessary to fully coat all the notes stored within the cash compartment and also eliminating the need for costly cleaning and maintenance of the control circuitry and other interior portions of the cash transport system after each deployment. The ink can be further confined to even smaller volumes within the cash compartment by use of a plastic liner that funnels ink inside the liner to the volume where notes are stored.

Another objective of the current invention is to provide a modular spike plate assembly consisting of a molded plastic spike plate with a combination of sharp protruding spikes oriented in the direction of the ink pouch along with perforations leading to the cash compartment, and a series of ink channels that guide the ink from the spikes over to the perforations. The molded spike plate has a symmetric design about the x and y axes such that an array of spike plates may be placed side by side to form larger spike plates. Each spike plate is secured into a perforated metal tray whose perforations are aligned to the perforations within each spike plate. The securing method is preferably through the use of screws but can also be accomplished through snaps or track features. The modular design accommodates the creation of transport cases with larger and smaller cash compartment areas using the same plastic tooling and mechanical design.

Yet another objective of the current invention is to provide a cash compartment of sufficient dimension suitable for accommodating a standard cash cassette capable of storing up to several hundred bills of the variety that can snap into a bill validator. Preferably the cash cassette has a side access door that, when open, exposes the long edge of each bill. When installed into the cash compartment, the side door is held open such that upon ink deployment, ink can flow unimpeded onto the bills within the cassette. In the preferred embodiment, the cash cassette is previously installed in a smart safe in which all money stored within the cassette is tracked electronically by the safe. The cassette is then transferred to the cash transport system and the value of the contents within the cassette is communicated to the cash transport system by way of a communication link from either the smart safe, a backroom server associated with the smart safe, or from the cassette itself using an RFID tag or other wireless means.

Yet another objective of the current invention is to provide a way to interchange a cash compartment module with a bill validator module configured to be controlled and powered by the same control electronics. In this approach, the bill validator module is further configured to have its bill accepter slot accessible from outside of the transport case such that it can accept bills while the case is sealed shut. In this manner, the cash can be protected within the locked transport case from the moment the bill is fed into the validator until the time the case is emptied at a secure bank location.

A more complete understanding of the present invention, as well as further features and advantages of the invention, will be apparent from the following Detailed Description and the accompanying drawings.

BRIEF DESCRIPTION OF THE DRAWINGS

FIG. 1 shows a front view of a transport case in accordance with one embodiment of the invention;

FIG. 2 shows an exemplary configuration of tamper detection sensors that protect an internal volume of the case of FIG. 1;

FIG. 3 shows a close-up view of a keypad area of the case of FIG. 1;

FIGS. 4 and 5 show an area of the transport case behind a center partition;

DETAILED DESCRIPTION OF THE DRAWINGS

Figure 8A:
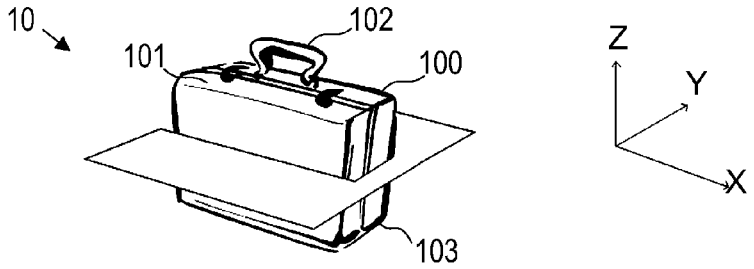
FIG. 8A shows a perspective of the transport case.

FIG. 1 shows a front view of a transport case 10 with a case exterior shell top removed for ease of illustration. FIG. 1 shows a case exterior shell bottom piece 100. Shell top 101, a handle portion 102 and a hinge 103 are seen in FIG. 8A which shows a perspective view of complete case 10. A center partition 400 is affixed to the shell bottom by way of screws 402 placed around the perimeter of the center partition. Preferably these screws are of a tamper-resistant security screw variety. An opening 14 is created in the center partition for the placement of a keypad and display user interface 410 shown in FIG. 3. A second cutout 15 in the partition is provided for a cash compartment 300 which is covered by an access door 301 sealed closed by captured screws 302. Door 301 when opened by undoing screws 302 hinges open about hinge 305.

Figure 7:
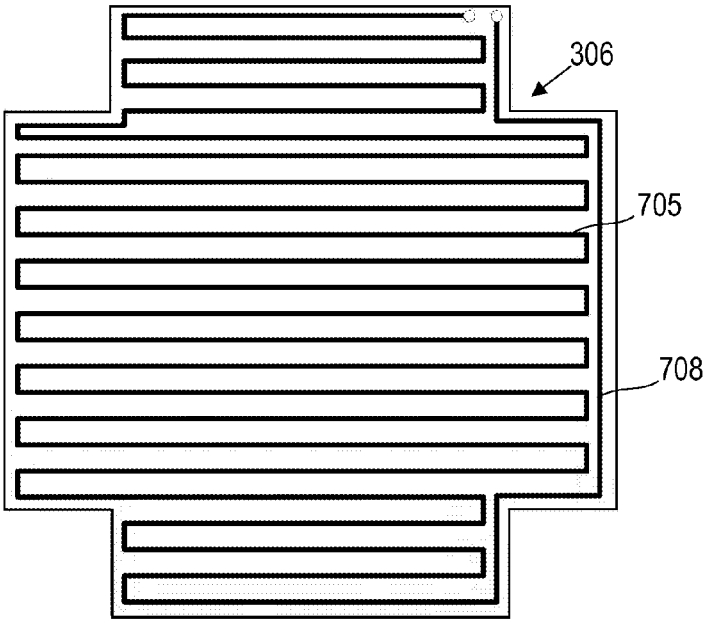
FIG. 7 illustrates details of a zig-zag conductive element suitable for use in conjunction with the case of FIG. 1.

FIG. 2 shows a configuration of tamper sensors 412 and 413 that protect the internal volume of the case in front of the center partition. A proximity and ambient light sensor 412 provides detection coverage of a window 418 shown as a cross-hatched circular projection. The detection window 418 extends above the keypad area 410. A temperature sensor 413 measures the spot temperature near the keypad. A puncture detection membrane 306 is fixed to the inner surface of the cash compartment lid 306. An exemplary puncture membrane 705 (shown in FIG. 7) consists of a zig-zag conductive element patterned on a plastic, paper, or fiberglass substrate 708. If the zig-zag element is broken at any point, control circuitry, such as an on-board microcontroller, programmed microprocessor, field programmable gate array (FPGA), application specific integrated circuit (ASIC), or the like, or some combination thereof (collectively "controller"), that monitors the normally low resistance of the element will detect an electrical open indicating an intrusion attempt. A second puncture membrane 404 of similar construction is placed underneath center partition 400 between the partition wall and a battery pack 403 (more easily seen in XY cross-section FIG. 8).

The cash compartment area is additionally monitored by a door sensor 309 which detects when the captured screw latches 302 are fully engaged and an ambient light sensor 307 installed against the inner wall of the cash compartment door. A wire harness 308 runs from the ambient light sensor and puncture sensors through the cash compartment case wall and over to the control board, as seen in FIG. 8. A DC power input connector 501 passes through the outer case shell 100 and carries electrical power over a wire harness 502 to control board 401. This electrical power is also used to recharge the battery pack 403.

FIG. 3 shows a close-up view of the keypad 410. LED display 411 provides basic feedback to the transport case user such as indications of proper code entry. Sensors for monitoring motion and light near the keypad area 412 and for monitoring temperature 413 are positioned to detect activity or break-in attempts in the area of the transport case above the keypad. A USB interface 414 is available for the purpose of transferring data to or from the control board.

Figure 5:
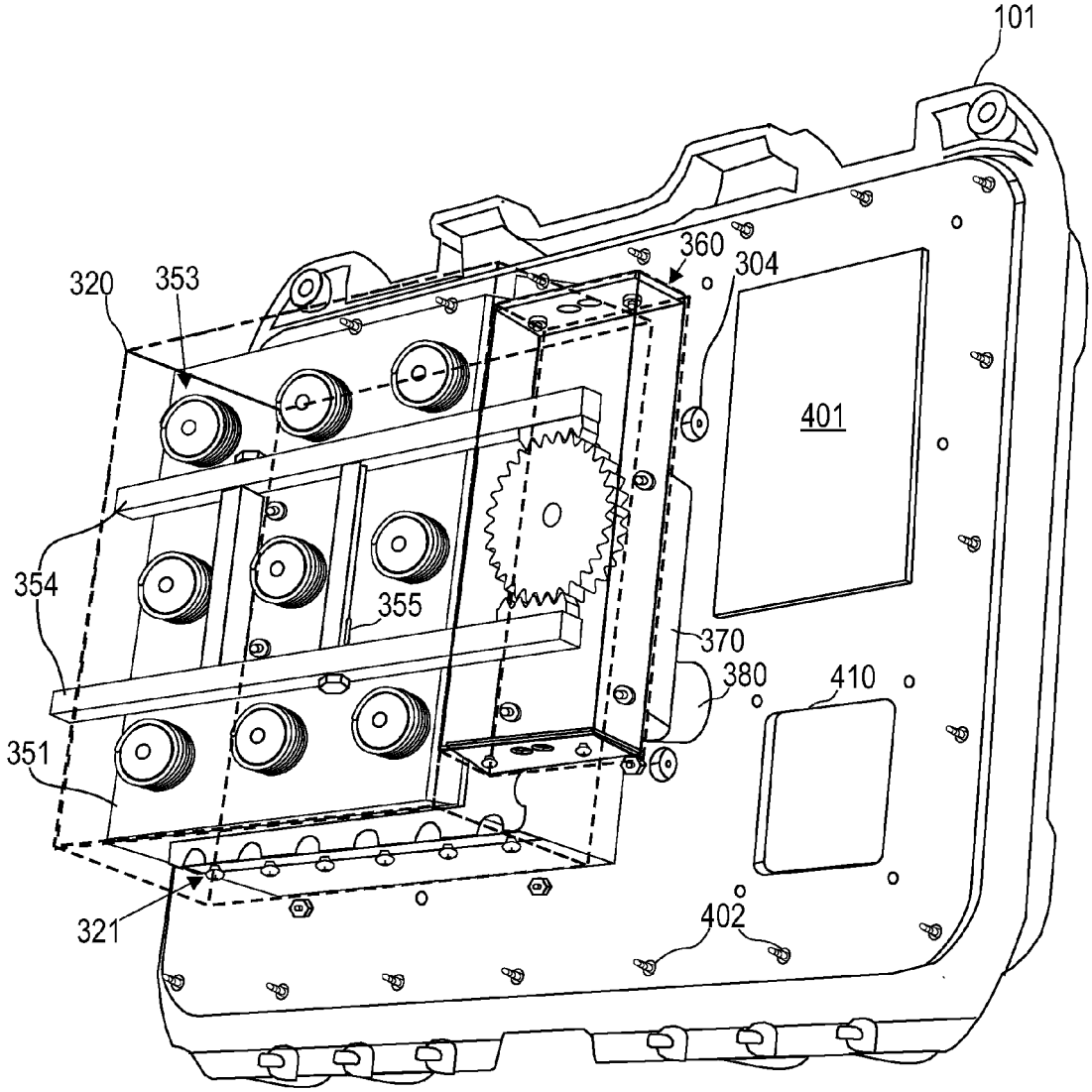

FIGS. 4 and 5 show the area of the transport case 10 behind the center partition. From this view, the main control board 401 can be seen, which contains the controller, additional security sensors, and drive circuitry for the ink deployment mechanism and alarms. The latch motor 380 is attached to gear box 370 and motor assembly bracket 360. The motor is configured to receive a control signal from control board 401 to disengage latch bars 354 from the latch bracket 352 during an ink deployment event.

Figure 6:
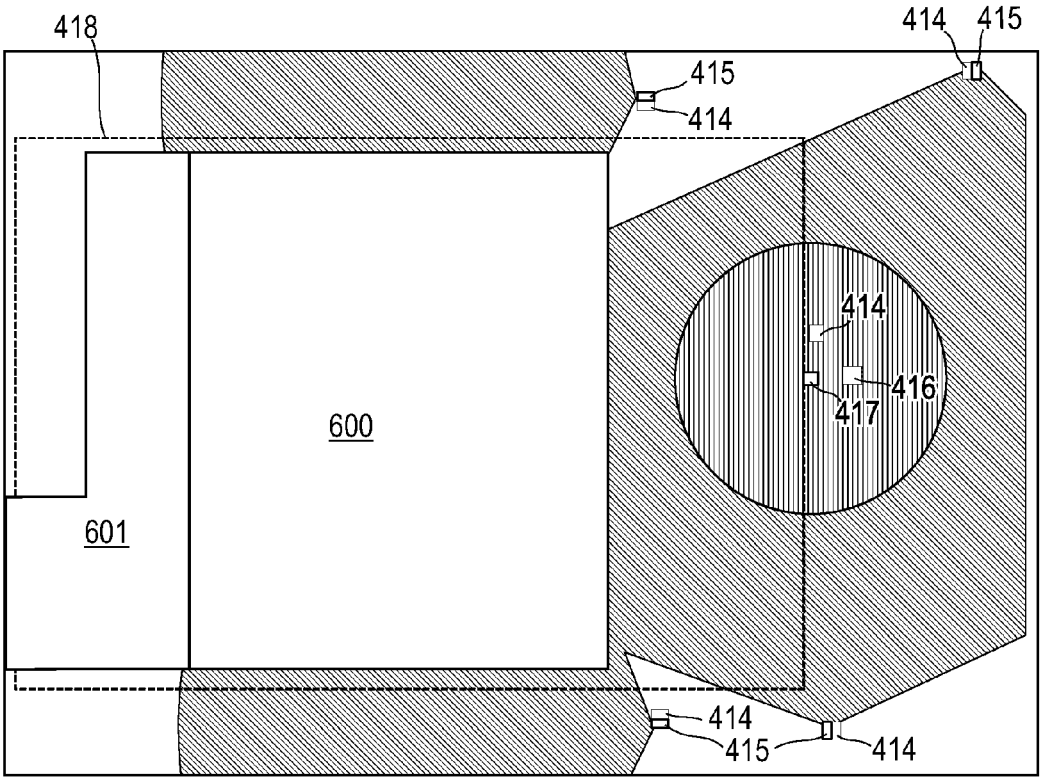
FIG. 6 illustrates an arrangement of proximity, light, temperature and puncture sensors configured to detect tampering with the case of FIG. 1.

Behind the center partition, proximity, ambient light, temperature, and puncture sensors are configured to detect tampering. A presently preferred arrangement is shown in FIG. 6. Multiple ambient light sensors 415 are oriented to be side-firing such that their detection angle extends parallel to the surface of the center partition. The zone of light detection forms the shape of a cone as shown in the diagram. Temperature sensors 414 are placed near each of the ambient light sensors 415 to monitor for extreme temperatures at those locations such as those associated with attempts to melt or freeze the transport case or contents inside. Additionally, a temperature sensor, a proximity sensor 417 and an accelerometer 416 are located on the control board 401. The proximity sensor on the control board functions in a similar manner as the one mounted on the keypad 410 in that it detects motion of objects nearby as well as any motion of the outer case shell 100 or the motor housing 360, with respect to the control board 410. To further detect tampering with the cash stronghold module 320 or the latch motor housing 360, a further puncture sensor 418 is wrapped around these subassemblies and wired into the control board for monitoring.

All sensors located remotely from the control board are preferably configured with serial communication links such as I2C, and can be individually addressed so they can be wired along a common harness back to the control board 401. Furthermore, the idle state of the electrical signals on the wires that comprise the harness can be monitored by the control board to determine if the harness is cut. For instance, the idle state on each wire of the I2C serial link may be 3.3V as the result of a pull up resistor to a 3.3V supply rail located at the most remote sensor in the daisy chain link of sensors. If the link is cut, the I2C lines in their idle state would register 0V at the controller.

Figure 9:
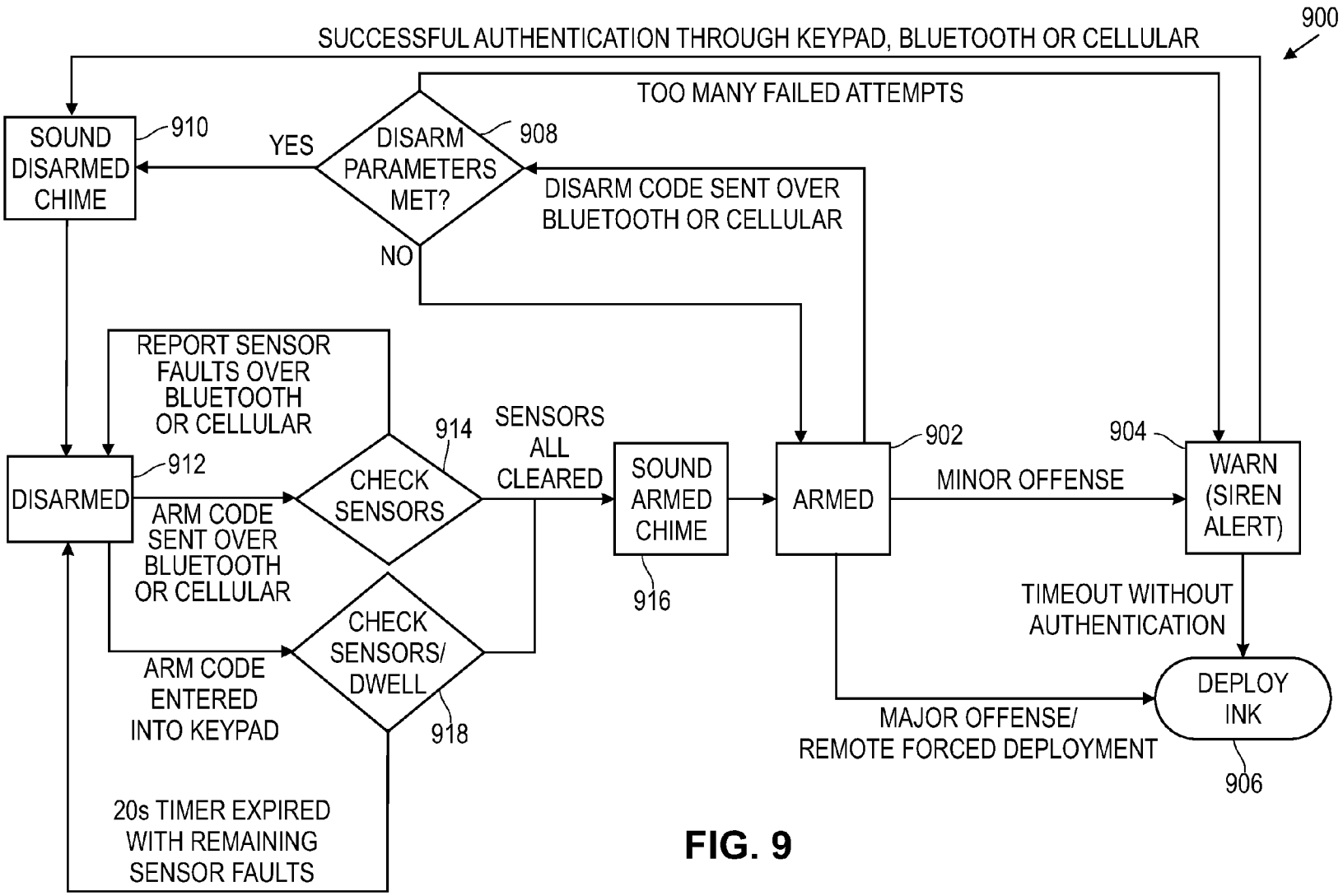
FIG. 9 shows a state machine for a controller that may be suitably employed to control internal systems of the transport case.

Depending on the state of the transport case in addition to which tamper sensor has been triggered, the controller will respond differently as shown in the FIG. 9 state machine 900. When in the armed state 902, tamper sensor activity can be classified as either a minor offense or a major offense. Minor offenses may include opening the outer case without first disarming it through an RF means, such as with a Bluetooth® or cellular link, this type of offense would involve the ambient light and proximity sensors located in front of the center partition. Minor offenses may also include small periodic vibrations or small impacts detected by the accelerometer. Major offenses would be the detection of any extreme temperatures at the monitored locations around the case, any detected puncture events, or any motion or light detected behind the center partition or within the cash box. Additionally, opening the cash compartment door, as indicated by the door sensor, before disarming would also classify as a major offense.

Minor offenses result in the transport case entering a warn state 904 in which an audible alert is given. Once in the warn state, the operator must successfully disarm the case within a period of time or the case will deploy ink to the cash in deploy ink state 906. A major offense results in the immediate deployment of ink. Upon detection of disarm parameters met in state 908, audible feedback in sound disarmed chime state 910 may be given to indicate that the operator may proceed to open the case. The case is disarmed in disarmed state 912 and the operator the opens the case and accesses the cash stronghold module. Security parameters may be configurable to only allow for disarming during certain times of day or when the case is located in certain predetermined locations. To arm the case, the operator enters an arming code on the keypad or an arm code is sent over Bluetooth® or a cellular connection. Sensors are checked in check sensors state 914. If the sensors are all clear, an audible signal is produced in sound armed chime state 916, and the case is armed in armed state 902. Preferably, a dwell time is employed for checking sensors in check sensors/dwell state 918. If sensor faults remain at the end of the dwell time, for example, 20 seconds, the state machine proceeds back to disarmed state 912.

Figure 8B:
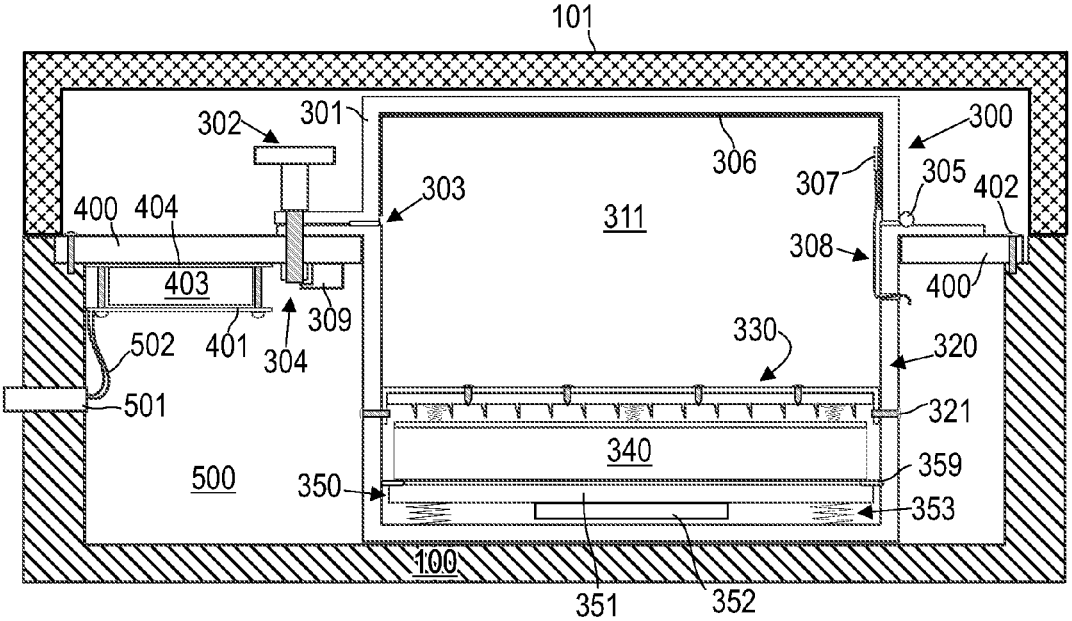
FIG. 8B shows a cross-sectional view of the transport case of FIG. 1 and FIG. 8A in the xy-plane of FIG. 8A.
Figure 10:
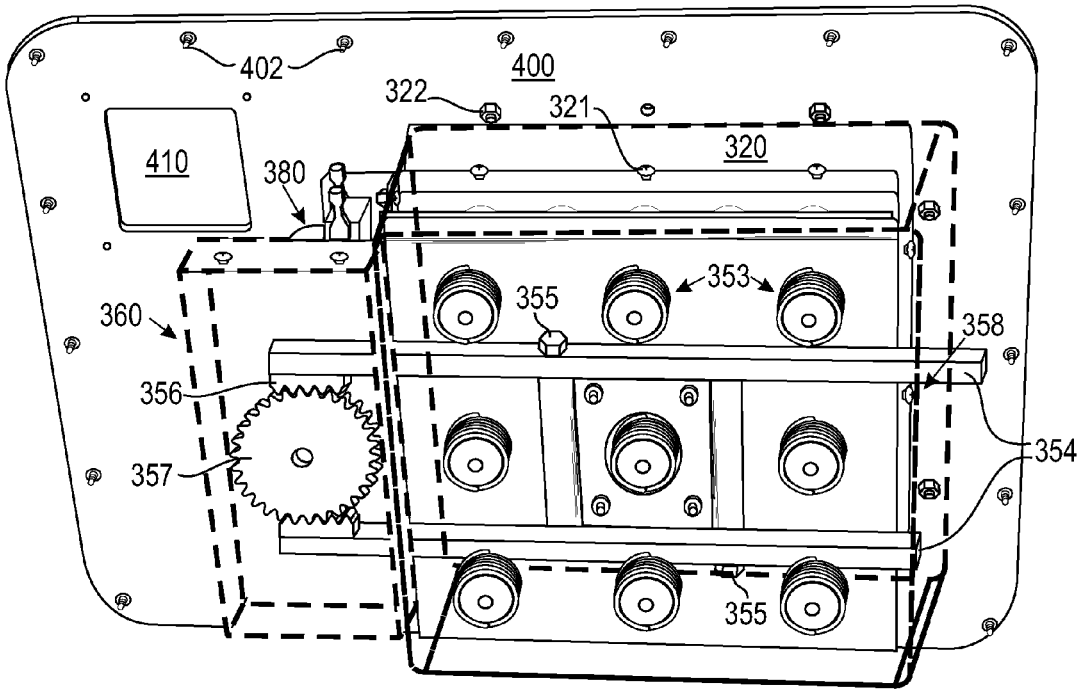
FIG. 10 shows a bottom perspective view of the space below the partition with metal housings made transparent for purposes of illustration.

FIG. 8A shows a perspective view of the transport case 10, and FIG. 8B shows a cross-sectional view of the transport case 10 in the XY plane of FIG. 8A. The cash compartment 320 is attached to a rectangular opening in the center partition 400. On the bottom of the compartment is a spring plate assembly 350 that comprises multiple compression springs 353 configured to launch a spring plate 351 in the direction of the cash storage area 311. A latch bracket 352 is rigidly attached to the spring plate and retained by a pair of latch bars 354 with retention bolts 355 as shown in the bottom perspective view of the space below the center partition with the metal housings made transparent in FIG. 10.

The latch bars 354 pass through rectangular openings in the cash compartment bin 320 and enter a latch motor housing 360. Gear teeth 356 installed on the ends of each latch bar interface to motor gear 357 that spins in the counter-clockwise direction when an electrical drive signal is sent to motor 380. Upon a quarter turn rotation of gear wheel 357, the upper latch bar is pulled further into the motor housing 360 and its associated retention bolt 355 slides out from underneath the latch bracket 352. Meanwhile, the lower latch bar 354 is pushed further out of the motor housing 360 and its associated retention bolt 355 slides out from underneath the latch bracket 352. In this manner, the latch bracket is symmetrically held in place by the two latch bars before the motor drive engages, and then is symmetrically released after the motor turns approximately one quarter revolution. A safety pin 358 can be installed in the latching bar to prevent accidental spring plate deployment while resetting the spring plate back in the compressed position.

Figure 12:
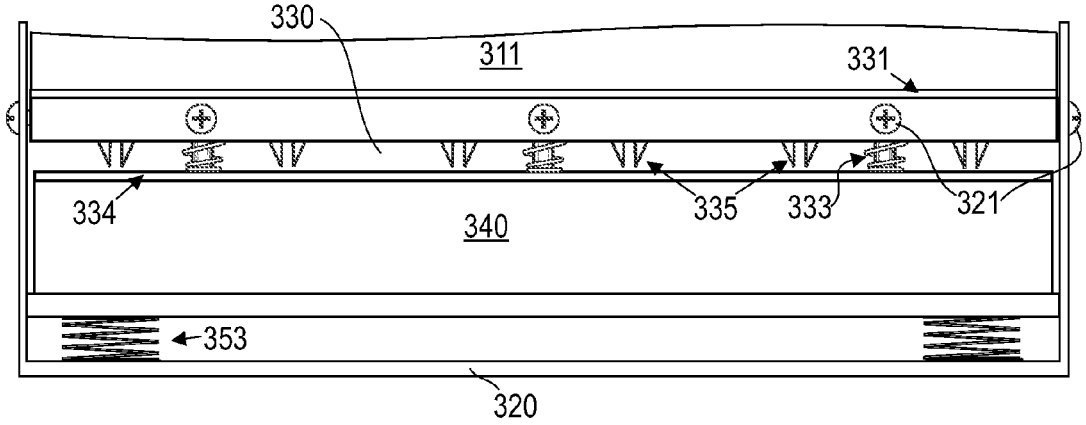
FIG. 12 shows a close-up cross-sectional view of an ink pouch and spike plate assembly.

Returning to the cross-sectional diagram in FIG. 8B, the ink pouch 340 is above the spring plate 351. The ink pouch is not under pressure prior to a sensed attempt to tamper with the mobile cash transport apparatus. A gasket 359 is installed around the perimeter of the spring plate to inhibit the flow of ink backwards into the spring plate assembly 350 after deployment. FIG. 12 shows a close-up cross-sectional view of the ink pouch and spike plate assembly. The spike plate assembly 330 sits on top of the ink pouch 340 and is anchored to the cash compartment bin 320 through side entry screws 321. Sharp spike tips 335 are molded into a perforated plastic spike plate 332 and held separated from the ink pouch in the armed state through the use of a perforated pouch stiffener plate 334 that is suspended away from the spikes through the use of several small compression springs 333. Above the molded spike plate is a metal perforated tray 331 that forms the floor of the cash storage area 311. The perforations in the spike plate, stiffener plate, and storage area floor allow for the flow of ink from the ink storage area into the cash storage area after ink deployment is triggered.

Figure 13:
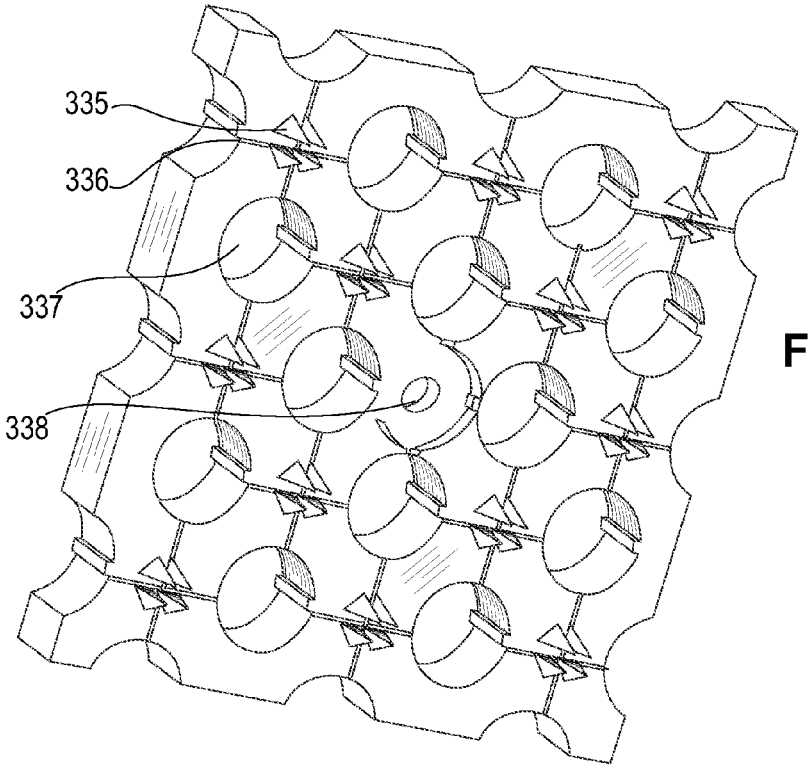
FIG. 13 illustrates a detailed view of a plastic spike plate.

FIG. 13 illustrates a detailed view of the plastic spike plate 332. The spike structure 335 is comprised of four individual spike tips to increase the contact pressure with the ink pouch during deployment. Ink channels 336 direct the flow of ink from the spike feature to the perforated openings 337 that pass ink through to the cash storage area behind the spike plate. A dimple feature 338 in the center of the plate captures the compression spring 333 which can be further confined in place through the use of a small short rod fed through the center of 338.

Figure 14:
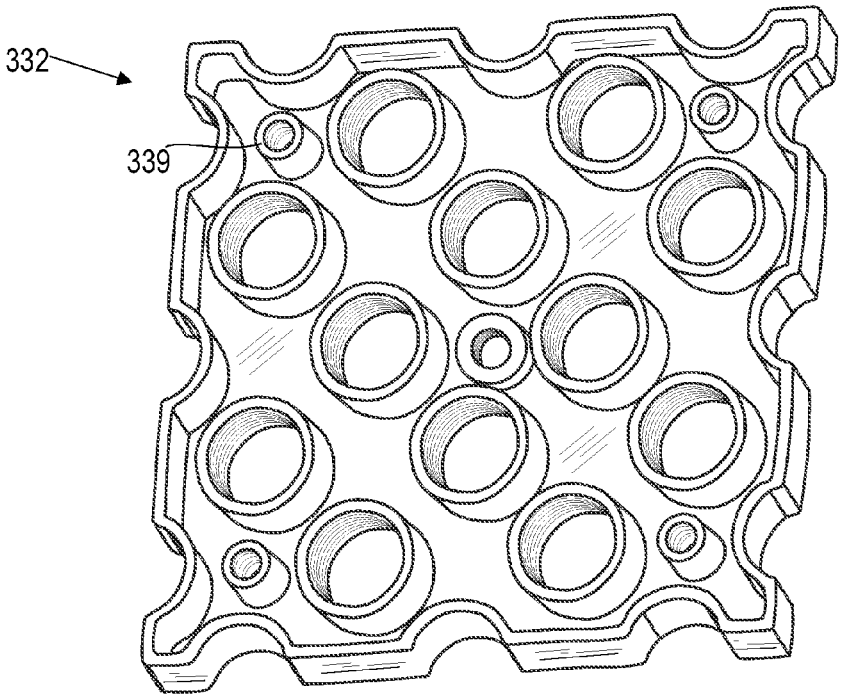
FIG. 14 shows a rear view of a spring plate.

A rear view of the spring plate is shown in FIG. 14. Screw bosses 339 enable the spring plate to be rigidly affixed to the metal perforated tray 331 at four positions around the perimeter of the spike plate. Several plastic spike plates can be installed to a single metal perforated tray 331 to provide the benefit of reduced tooling cost for the molded plastic part and to enable the use of the same spike plate for multiple sizes of cash compartments. For instance, an array of four spike plates arranged in a two by two square is preferable for the disclosed invention to form one large spike plate assembly. Smaller spike plate assemblies could be formed using a two by one array, for example. Larger rectangular assemblies can also be formed using a two by three array of spike plates, for example, to accommodate larger cash compartments. The perforated tray can be held rigidly to the cash compartment walls 320 by way of several screws or other fasteners 321, as seen in FIG. 8B. In an alternative embodiment, the molded plastic spike plates 332 may have screw bosses around their perimeter that can be captured by screws 321.

In FIG. 8B, the cash storage area, 311 is enclosed by a cash compartment door 301 which is held closed by a latching mechanism 304 and can be opened by turning a knob 302. This latch mechanism is preferably a captured screw type assembly. When the door latching mechanism is released, the door s free to swing on hinge 305 in the clockwise direction provided that the outer case shell is open so that there is no interference from the top shell wall 101.

Figure 11:
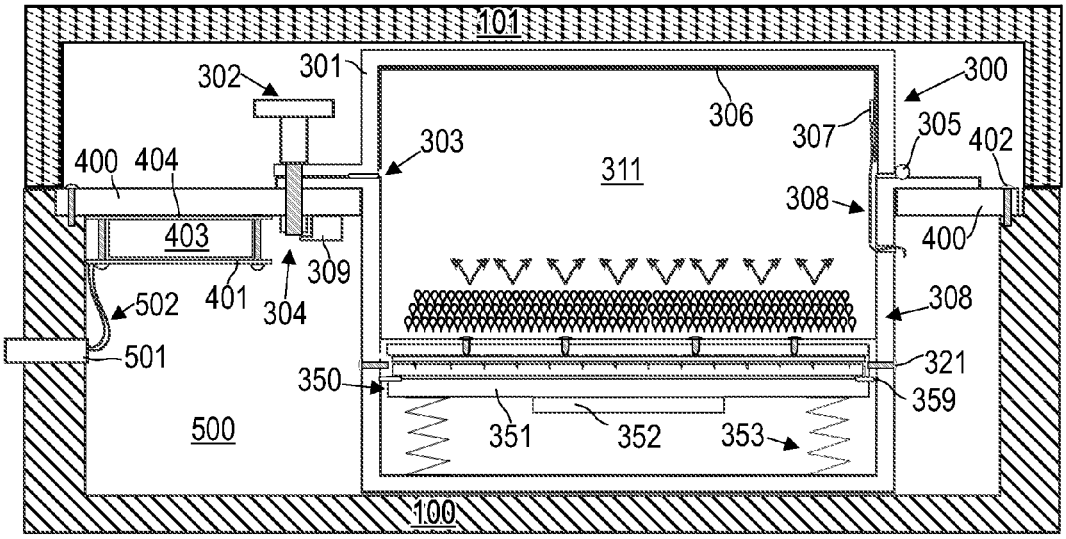
FIG. 11 illustrates the state of the ink pack in the moment just after deployment.

FIG. 11 illustrates the state of the ink pack in the moment just after deployment. As previously mentioned, ink deployment occurs when an electrical drive signal is sent to motor 380 which releases latch bracket 352. Once released, the compression springs 353 propel spring plate 351 into the ink pouch. The compression springs 353 necessarily have a substantially greater spring constant than the compression springs 333 such that the ink pouch stiffener plate 334 is driven flat against the spike plate assembly and exposing the spike tips 335 to the ink bag. Due to the considerable spring force provided by compression springs 353, the ink bag is driven forcibly into the spike tips which cause a pressurized release of the ink onto the contents of the cash storage area 311.

Given that the cash storage area is sealed with gasket material 303, and that the spring plate is sealed with gasket material 359, substantially all the ink is confined within the cash storage area after deployment. In this manner, ink is efficiently dispersed on the cash stored within and little is wasted in other portions within the cash transport case. This results in a reduction of the amount of ink required, allows for easy cleanup post-deployment, and protects costly electronics from being damaged by exposure to the ink.

Figure 15:
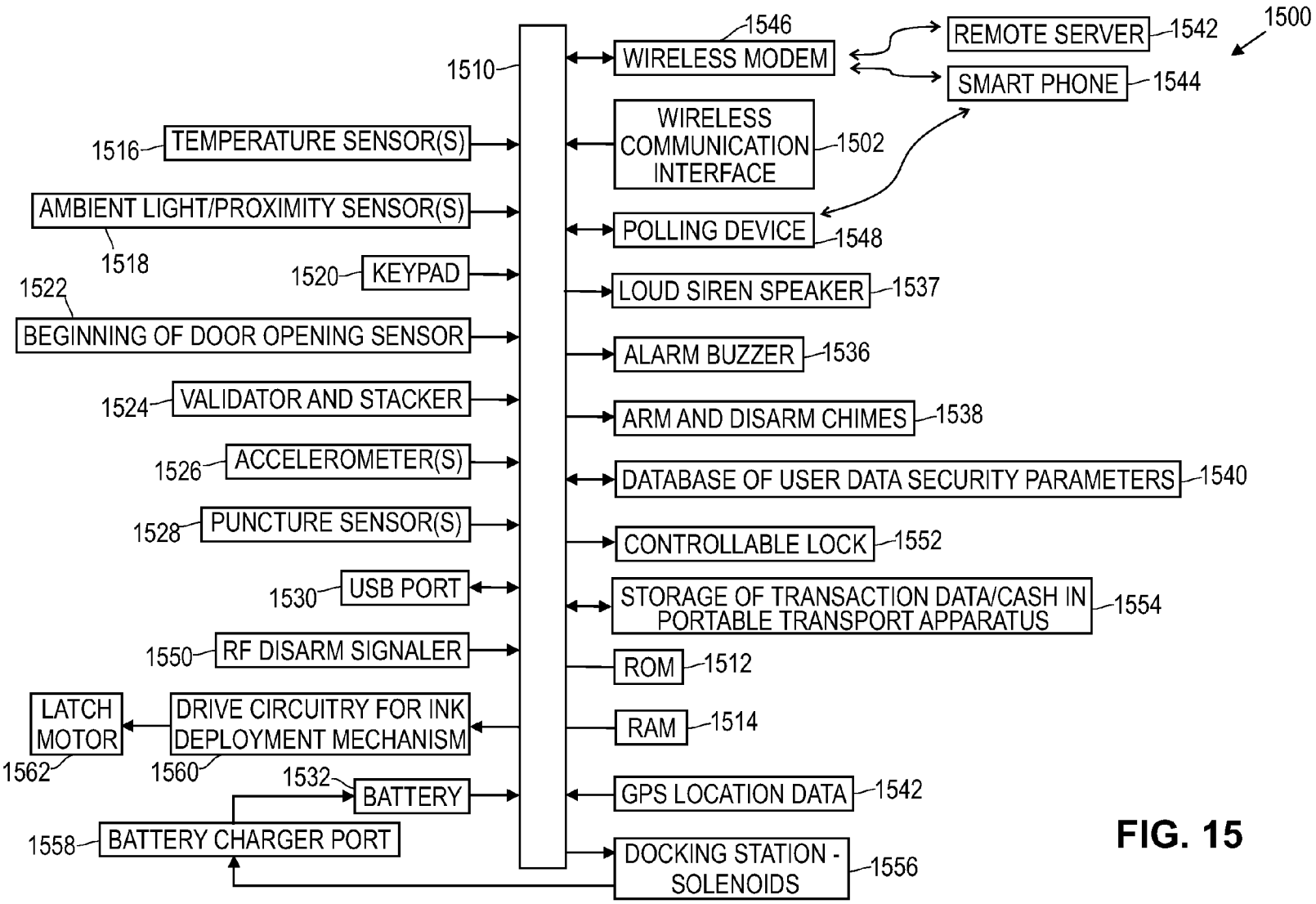
FIG. 15 shows a block diagram of a control system suitable for use in conjunction with the transport case of FIG. 1.

FIG. 15 shows an exemplary controller 1500 suitable for control of the transport case 10 of FIG. 1 including a programmed microprocessor 1510. As seen in FIG. 15, system 1500 includes memory, such as RAM 1512 and ROM 1514. Microprocessor 1510 receives a variety of inputs such as temperature data from a temperature sensor or sensors 1516, ambient light (ALS) and proximity sensor 1518, keypad 1520, beginning of door opening sensor 1522, an accelerometer or accelerometers 1526 for motion detection, puncture sensors 1528, a universal serial bus 1530, as well as, power from a battery 1 532.

Microprocessor 1510 also provides driver signals to user prompt LEDs and a buzzer 1534, drives a loud siren speaker, an audible alarm, such as buzzer 1536, and arm and disarm chimes 1538. The microprocessor 1510 also stores and retrieves data from a database 1540 of user data and security parameters. For example, database 1540 may suitably store user names along with their access codes and permission levels. The database 1540 may also store global positioning satellite (GPS) coordinates of valid destination waypoints, and identification numbers of wireless radio keypads, user smart devices or waypoint beacons. The ink deployment device herein may be used in conjunction with the portable cash transport case of U.S. application Ser. No. 14/302,555, filed Jun. 12, 2014, entitled "Methods and Apparatus for Mobile Cash Transportation" which is incorporated by reference herein in its entirety.

Controller 1510 can receive GPS data 1542 and compare data stored in database 1540. If the two do not match up appropriately, an alarm can be sounded using loud siren speaker 1536 and a supervisor or other authorized personnel can be notified by sending an alert to a remote server 1542, a smart phone 1544, or the like.

Microprocessor 1510 also may suitably communicate to a remote computer utilizing a modem or wireless modem 1546. A polling device 1548 in the portable case 10 can poll a user and then communicate with microprocessor 1510. If the user does not respond to a polling attempt within a predetermined acceptable time to reply, the polling device 1548 informs microprocessor 1510 which then drives loud siren speaker 1536 to sound a loud audible alarm and to communicate the failure to authenticate to a supervisor through wireless communication interface 1502, wireless modem 1546, or the like.

When a disarm signal is received from an RF disarm signal unit 1550 or the correct sequence of keystrokes is received from keypad 1520, the microprocessor 1510 disarms the portable case 10 allowing an operator to access cash storage. In a presently preferred embodiment, the portable cash transport apparatus 10 is light and its plastic case is relatively easy to drill into or otherwise attack by a vandal or thief. Security is primarily provided by detecting such attacks, activating an alarm, and reporting the attack. However, it will be recognized a sturdier case may be employed utilizing a controllable lock 1552 to lock and unlock the case.

Similarly, the portable case 10 can be armed employing an RF arm signal unit 1551. As cash is deposited, sales are made and the like, storage transaction data, such as the current amount of cash in the portable transport apparatus 10 is stored in storage 1554. Such data can be subsequently retrieved and analyzed to provide useful information about times when sales are most frequent, and the like.

In a presently preferred embodiment, when the portable transport apparatus 10 is inserted in a docking station 1556, the microprocessor 1510 provides control signals causing solenoids in docking station 1556 to lock the portable transport apparatus 10 in place. Power is supplied by the docking station 1556 through a connector (not shown) to a battery charging port 1532, such as connector 501 of FIG. 8B. While connector 501 is shown in a side of the portable case 10, it will be recognized it can be in the bottom as well.

Additionally, microprocessor 1510 also provides a control signal to drive circuitry 1560 for the ink deployment mechanism. Drive circuitry 1560 in turn causes latch motor 1562 to disengage latch bars commencing ink deployment.

It will be clear that there are numerous configurations and embodiments possible using the technology and techniques described above. While the present invention is disclosed in the context of presently preferred embodiments, it will be recognized that a wide variety of implementations may be employed by persons of ordinary skill in the art consistent with the above discussion and the claims which follow below.

We claim:

1. A mobile cash transport apparatus comprising:

a cash storage area;

a sensing mechanism for sensing attempts to tamper with the mobile cash transport apparatus;

an ink delivery device for delivering ink to stain cash stored in the cash storage area, the ink delivery device comprising an ink pouch which is pressurized in response to a sensed attempt to tamper with the mobile cash transport apparatus by pressing the ink pouch and a plate assembly together;

a controller receiving inputs from the sensing mechanism and determining if detected attempts to tamper with the mobile cash transport apparatus warrant driving the ink delivery device to deliver ink to stain the cash; and a liner to limit ink deployment to a desired volume within the mobile cash transport apparatus thereby preserving portions of the mobile cash transport apparatus for reuse after ink deployment.

2. The mobile cash transport apparatus of claim 1 further comprising:

a bill validator for recognizing cash inserted therein and storing inserted cash in a storage cassette, wherein the cash storage area comprises the storage cassette, and;

the plate assembly further comprises plural spikes located in close proximity to the ink pouch and adjacent the cash storage area prior to pressing the ink pouch and the plate assembly together.

3. The mobile cash transport apparatus of claim 1 wherein the ink delivery device further comprises a spring biased mechanical system to rapidly pressurize and tear the ink pouch upon the controller driving the ink delivery device to deliver ink.

4. The mobile cash transport apparatus of claim 1 wherein a mechanical drive arrangement including a plurality of springs and a release mechanism controlled b the controller which rapidly pressurizes the ink pouch as part of an ink deployment process.

5. The mobile cash transport apparatus of claim 1 wherein the controller determines at least two distinct and different states of tampering based upon evaluation of inputs from the sensing mechanism.

6. The mobile cash transport apparatus of claim 1 wherein the cash storage area holds a cash storage cassette having an access door which is opened to access and remove cash, the access door being held open adjacent the ink pouch to allow ink to access cash within the storage cassette upon ink deployment.

7. The mobile cash transport apparatus of claim 2 wherein the storage cassette is made of a material porous to ink flow or includes holes to allow ink flow.

8. The mobile cash transport apparatus of claim 1 further comprising:

memory to store a current amount of cash stored in the mobile cash transport apparatus; and a communication interface to communicate the current amount of cash stored by the mobile cash transport apparatus and information regarding any attempt to tamper with the mobile cash transport apparatus detected by the controller.

9. The mobile cash transport apparatus of claim 1, wherein the ink delivery device employs a modular design to accommodate cash compartments of varying capacities.

10. The mobile cash transport apparatus of claim 1 further comprising:

a spike plate which is symmetrically designed from interlockable subplates.

11. The mobile cash transport apparatus of claim 1 wherein the sensing mechanism comprises an ambient light detector to detect a change of ambient light internal to the mobile cash transport apparatus and upon said detection, the controller determining a state of tampering therefrom.

12. The mobile cash transport apparatus of claim 11, further comprising a light tight plastic case.

13. The mobile cash transport apparatus of claim 5, wherein in the first state of tampering, an alarm is sounded, and in a second state of tampering, ink deployment is immediately commenced.

14. The mobile cash transport apparatus of claim 13 wherein an authorized user can disarm the cash transport apparatus within a predetermined period of time after the alarm is sounded, and if the cash transport apparatus is not disarmed within the predetermined period of time, ink deployment occurs.

* * * * *